US012049286B1

(12) United States Patent
Noble

(10) Patent No.: US 12,049,286 B1
(45) Date of Patent: Jul. 30, 2024

(54) TENDON SUPPORT BUOYANCY SYSTEM AND METHOD

(71) Applicant: NuEnergy Partners, LP, Beaumont, TX (US)

(72) Inventor: Thomas H. Noble, Beaumont, TX (US)

( * ) Notice: Subject to any disclaimer, the term of this patent is extended or adjusted under 35 U.S.C. 154(b) by 400 days.

(21) Appl. No.: 17/469,608

(22) Filed: Sep. 8, 2021

Related U.S. Application Data

(63) Continuation-in-part of application No. 17/102,014, filed on Nov. 23, 2020, now Pat. No. 11,591,051.

(60) Provisional application No. 63/076,156, filed on Sep. 9, 2020, provisional application No. 62/938,743, filed on Nov. 21, 2019.

(51) Int. Cl.

| | |
|---|---|
| ***B63B 21/50*** | (2006.01) |
| ***B63B 35/44*** | (2006.01) |
| ***B63B 39/02*** | (2006.01) |
| ***B63B 79/10*** | (2020.01) |
| ***B63B 79/40*** | (2020.01) |

(52) U.S. Cl.
CPC ..... *B63B 21/502* (2013.01); *B63B 39/02* (2013.01); *B63B 79/10* (2020.01); *B63B 79/40* (2020.01); *B63B 35/44* (2013.01); *B63B 2035/446* (2013.01)

(58) Field of Classification Search
CPC ..... B63B 21/00; B63B 21/502; B63B 79/00; B63B 79/10; B63B 79/40; B63B 39/00; B63B 39/02; B63B 35/00; B63B 35/44; B63B 2035/446; B63B 13/00
USPC ..... 114/124
See application file for complete search history.

(56) References Cited

U.S. PATENT DOCUMENTS

| | | | | |
|---|---|---|---|---|
| 3,082,608 | A * | 3/1963 | Daniell | B63B 35/4413 405/223.1 |
| 6,884,003 | B2 * | 4/2005 | Horton, III | B63B 35/4413 405/224.2 |
| 9,573,662 | B2 * | 2/2017 | Amate López | B63B 35/44 |
| 10,518,849 | B2 * | 12/2019 | Lim | B63B 35/44 |
| 11,591,051 | B1 * | 2/2023 | Noble | B63B 79/40 |
| 2004/0028479 | A1 | 2/2004 | Horton, III | |
| 2004/0052586 | A1 | 3/2004 | Horton, III | |
| 2004/0161984 | A1 | 8/2004 | Lima de Almeida et al. | |
| 2004/0253059 | A1 | 12/2004 | Horton, III | |
| 2007/0212170 | A1 | 9/2007 | Hawley | |
| 2011/0083853 | A1 | 4/2011 | Pionetti | |
| 2015/0075417 | A1 | 3/2015 | Khachaturian | |
| 2019/0078556 | A1 | 3/2019 | Stiesdal | |

* cited by examiner

*Primary Examiner* — Lars A Olson
(74) *Attorney, Agent, or Firm* — Werner IP Law, P.C.

(57) ABSTRACT

A system for supporting and/or tensioning a subsea tendon. The system includes a cylindrical vessel forming a chamber, there being an air control valve proximate the top end of the vessel and a water vent proximate the bottom end of the vessel. A source of high pressure air is operatively connected to the chamber whereby ballasting and deballasting of the vessel can be easily accomplished by remote operation of the air control valve. The system further includes a yoke having a clamp mounted thereon, the yoke being releasably connectable to the cylindrical vessel and operative to connect to hoisting lines such as chains.

13 Claims, 3 Drawing Sheets

FIG. 4
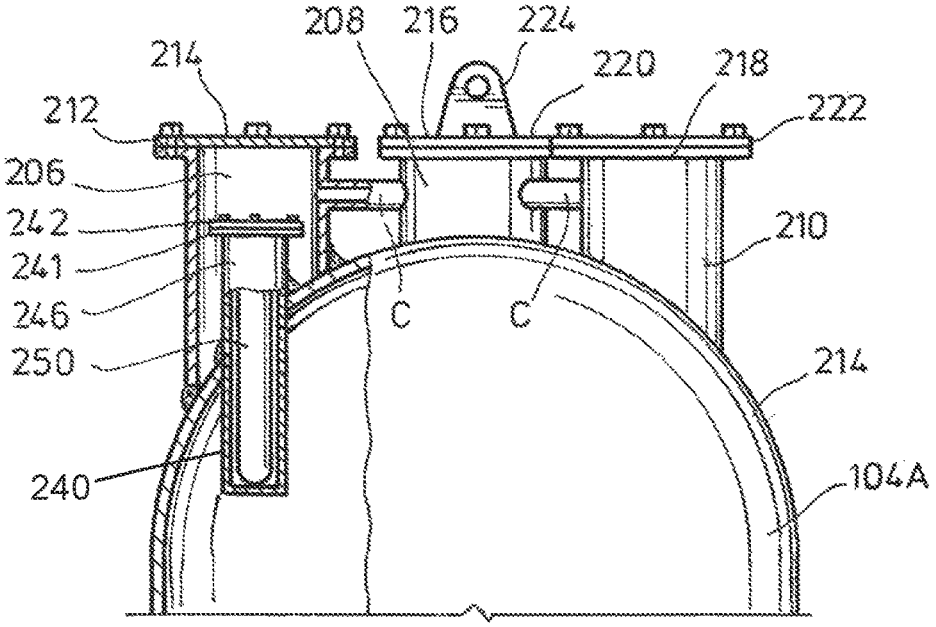
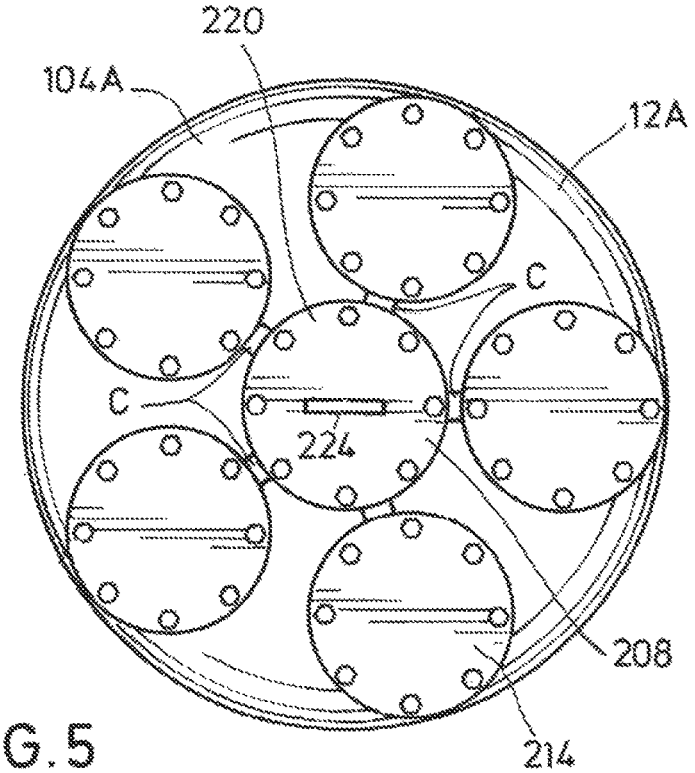
FIG. 5
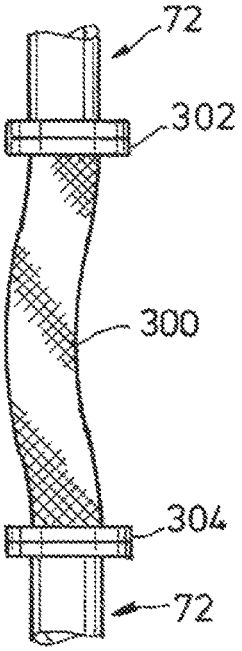
FIG. 6

TENDON SUPPORT BUOYANCY SYSTEM AND METHOD

FIELD OF THE INVENTION

The present invention relates to offshore structures and, more particularly, to buoyancy support systems for tendons and other elongate members used with offshore platforms, particularly tension leg platforms for wind turbines.

BACKGROUND OF THE INVENTION

In an attempt to control climate change due to the use of fossil fuels, there is an increasing focus on renewable energy sources such as wind turbines. Initially wind turbine generators for producing electric power were largely on shore structures. At the present time, the vast majority of offshore energy generation (OEG) comes from platforms/wind turbines in shallow waters. This is no doubt due to the complexity of offshore, particularly deep water support structures, e.g., platforms and the like. Nonetheless, land based and shallow water based generation of electric power is becoming limited by space considerations. Accordingly, the technology is shifting toward developing turbine support structures which can be used in deeper offshore waters.

Current, floating turbine support systems fall generally into three categories—spar-buoy, semi-submersible, and tendon leg platform (TLP). In the construction of TLPs, typically a semi-submerged buoyant structure is anchored to the sea bed with tension mooring lines, commonly referred to as tendons.

Tendons for use with offshore platform construction have been used for many years, particularly in the construction of offshore platforms for oil and gas exploration and production. A typical tendon support buoy (TSB) which has been used for many years is one designed by Detailed Design, Inc. These TSBs are generally made to accommodate tendons or pipe having diameters from 22 to 40 inches. Accordingly, the TSBs are large, e.g., from about 24 feet in diameter and 90 feet in length. There is presently a need for buoyancy systems, particularly TSBs, which can accommodate smaller diameter elongate members, e.g., tendons that have a diameter of between 8 to 20 inches. For cost and safety reasons, there is also a need for TSBs which greatly reduce the use of underwater or in the water activities such as remotely operated vehicles (ROVs) and divers.

SUMMARY OF THE INVENTION

In one aspect, the present invention relates to TSBs for use in mooring systems for platforms for offshore wind turbines.

In another aspect, the present invention relates to TSBs which can be used to suspend tendons and other elongate mooring members prior to installation.

In a further aspect, the present invention relates to a TSB which can be remotely operated to incrementally regulate buoyancy.

In yet another aspect, the present invention relates to TSB systems and methods which greatly reduce the use of ROVs, divers, and other, "in the water" auxiliary equipment for installation of tendon mooring systems.

These and further features and advantages of the present invention will become apparent from the following detailed description, wherein reference is made to the figures in the accompanying drawings.

BRIEF DESCRIPTION OF THE DRAWINGS

FIG. 4 is a partial elevational view of another embodiment of the TSB of the present invention.

FIG. 5 is a top plan view of the TSB shown in FIG. 4.

FIG. 6 is a side, elevational view of a flexible, tubular that can be used in one embodiment of the present invention.

DETAILED DESCRIPTION OF PREFERRED EMBODIMENTS

Figures 1, 2:
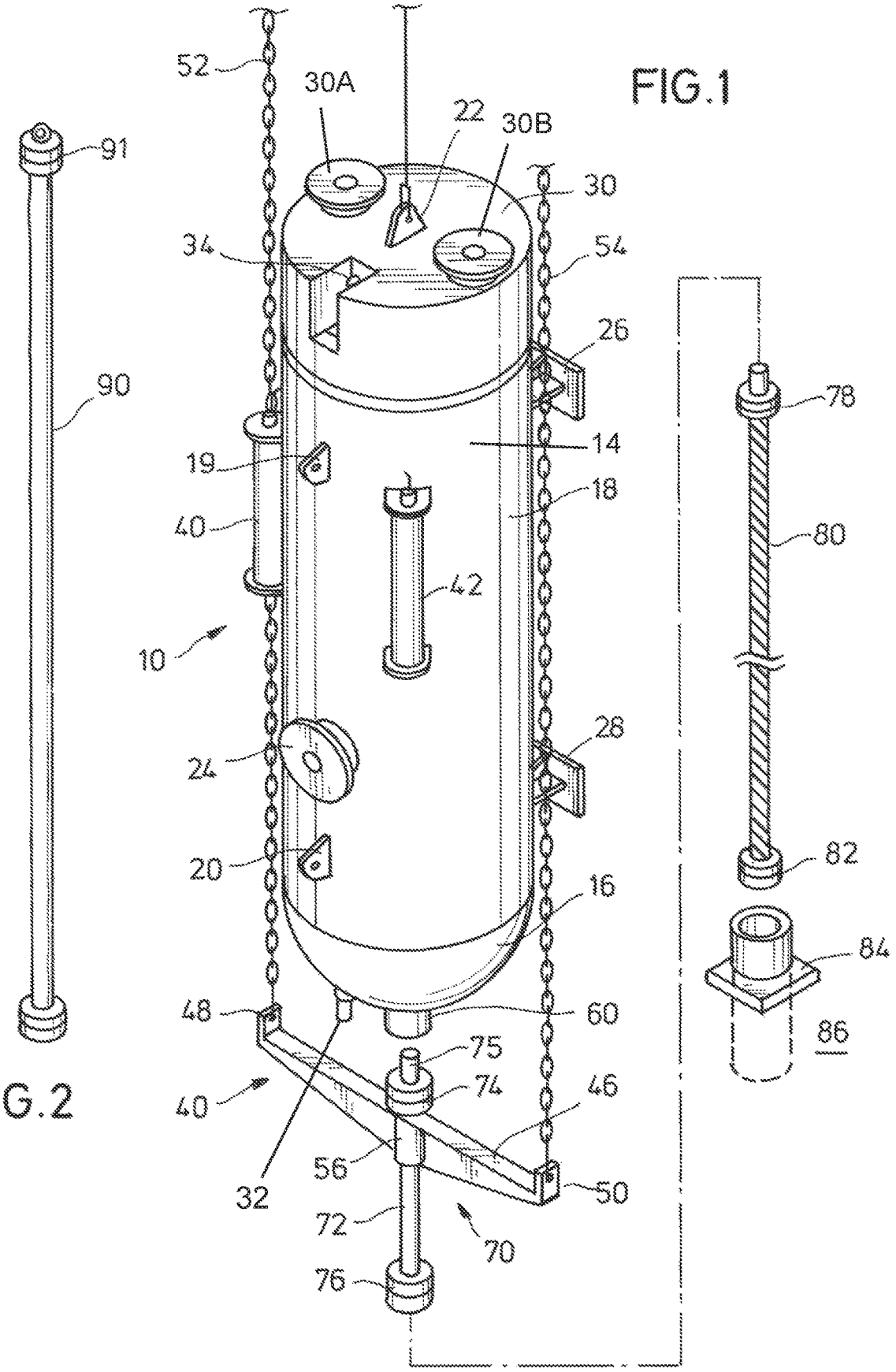
FIG. 1 is a perspective, environmental view of one embodiment of the TSB of the present invention.
FIG. 2 is an elevational view of a flexible tendon used with the TSB of the present invention.

Referring first to FIG. 1, there is shown a perspective view of one embodiment of the TSB of the present invention. The embodiment of FIG. 1, shown generally as 10 comprises a generally cylindrical vessel 12 having a top end 14 and a bottom end 16. The vessel 12 is provided with side lifting pad eyes 18 and 20 as well as a top pad eye 22, the pad eyes being used in handling and manipulating the TSB. Vessel 12 has a hatch cover 24 over a manway allowing access to the interior chamber formed by vessel 12 for servicing and maintenance when not in use. Connected to vessel 12 are saddles 26 and 28 upon which vessel 12 can rest when on a deck or the like.

In one embodiment, there is a control module 30 mounted on the top end 18 of vessel 12, nozzles 30A and 30B extending from module 30. The use of nozzles is described more fully hereafter. The control module 30 can include air pressure and water level depth sensors in the chamber formed by vessel 12, such detectors/sensors being well known to those skilled in the art. The control module 30 is configured to receive acoustic signals from a master controller (not shown) on the deck of a tender used in the deployment of the TSB. Accordingly, the onboard master controller on the work boat/tender is configured to communicate with the control module 30, preferably by acoustic signaling, and to this end the onboard master controller includes a PLC or other programmable module. There can also be a handheld device which communicates with control module 30 by which an operator on the tender can control the various functions of the TSB.

There is a water vent 32 connected to vessel 12 proximate the bottom end 16 thereof and there is also an air control valve 34 located proximate the top end 18 of vessel 12. It will be understood that control valve 34 can be connected to the control module 30 or can directly communicate with the master controller on the deck of the tender. Valve 34 can be a solenoid valve or similar valve that can be remotely operated by acoustic or similar wireless signals.

To supply air to the chamber formed by vessel 12, there are compressed air cylinders 40 and 42 which are selectively in open communication with the chamber in vessel 12. While shown as being external of vessel 12, preferably the cylinders 40, 42 are disposed in a chamber formed in vessel 12. The air cylinders 40 and 42 can adapted to be operated from control module 30. Indeed since vent 32 is free flowing, ballasting of vessel 12 can be controlled mainly by controlling air pressure in vessel 12.

A harness assembly, shown generally as 44, comprises a yoke 46 having first and second ends 48 and 50, respectively, ends 48 and 50 being adapted, as shown, to be connectable to chains 52 and 54, respectively, which can extend from winches (not shown) on a platform on which the wind turbine is to be mounted. As will be seen hereafter, they are used to maintain the vertical position of the tendon until connected to the platform.

There is a clamp 56 connected to yoke 46 generally midway between ends 48 and 50. Clamp 56 is of the well-known type comprising first and second hinged sections which when closed form a nest for a tubular member received therein. Clamp 56, if necessary can be operated remotely from the master control system on the tender.

In use, the TSB 10 would be carried on a work boat/tender to where the tendons and the platform are to be installed. Upon arrival, the TSB/tendon assembly is made up and suspended from a cantilever platform on the side of the work boat/tender and hung down so that it has a vertical attitude. When deployed, TSB 10 comprises vessel 12, control module 30, and harness assembly 44 comprising yoke 46 as well as a sub assembly shown generally as 70, sub assembly 70 comprising a tubular member 72 to which is attached on one end a connector 74 having a guide 75 which is received on connector assembly 60 on the bottom of vessel 12. As can be seen, tubular portion 72 of sub assembly 70 is held in hinged clamp 74. At its lower end, sub assembly 70 comprises a rotolatch 76, well known to those in the art, which can be attached in a well known manner to a corresponding connection 78 located at the top end of a tendon 80 which is to be installed. On its lower end, tendon 80 has an adapter/connector 82 which can latch into subsea anchor 84 anchored into sea bed 86. Once tendon 80 is connected to TSB 10, TSB 10 and attached tendon 80 are lowered until tendon 80, via adapter 82, can connect/latch onto anchor 84.

Once the tendon 80 is latched to anchor 84, cylindrical vessel 12 can be deballasted and allowed to rise until there is the appropriate tension on tendon 80.

Figure 3:
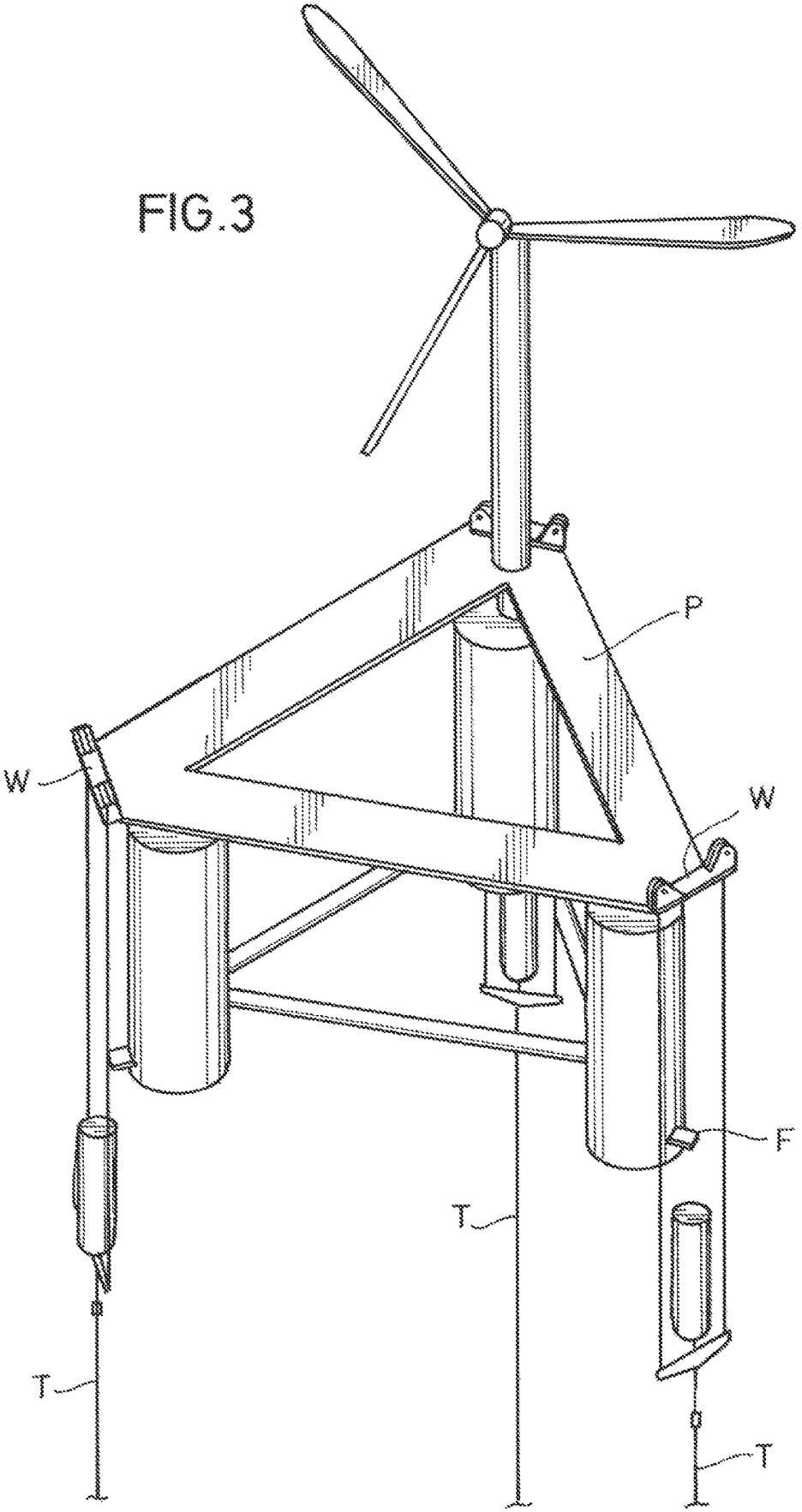
FIG. 3 is a schematic depiction of a suspended tendon array prior to being connected to a platform.

It will be appreciated that a plurality of tendons, generally three or four, are used, and in this regard as shown in FIG. 3, a suspended tendon array is held in a vertical position with suitable tensioning on the tendons T until a platform P is floated in place over the tendon array. Once the platform P has been ballasted to an installation depth, the chains 52, 54 extending from platform P are connected to the yoke 46 as at ends 48 and 50, and the winches W are actuated to draw up the chains 52, 54 to maintain the desired vertical position of the tendons T.

After TSB 10 has recovered, an adjustable final tendon joint such as joint 90 shown in FIG. 2, can be installed between the tendon connection fittings F on platform P using connectors, such as connector 91, on joint 90 and the anchored tendon using rotolatch or similar connectors. When all tendons are connected to the platform P, platform P can be deballasted to rise up to final operation depth. It will be appreciated as the platform P rises, connectors 91 on the end of the adjustable final tendon joint 90 will engage and latch to tendon connections fittings F on the platform P. Platform P will then be deballasted to add the necessary tensions to the tendons 80 to thereby secure the platform P in its final operating position.

The tendons which can be used with the TSB of the present invention can be tubular, or flexible and can include pipes, chains, cables, or composite cables. The adapters/connectors used in the system to connect the tendons can accordingly be configured to accept tendons which can be either rigid tubulars or flexible cables.

Turning now to FIGS. 4 and 5 there is shown one way in which the controllers on board the TSB can be housed so as to be in water tight compartments. In particular, there is shown a modified vessel 12A having a series of nozzles or compartments attached to the top end thereof. As best seen in FIG. 4A, there are a series of nozzles, three of which 206, 208, and 210 are shown. As can be seen, the nozzles can comprise tubular members which have bolt flanges connected to their upper ends, their being blind flanges connectable to the bolt flanges as seen above. Thus nozzle 206 is provided with a bolt flange 212 to which is bolted a blind flange 214. In like fashion, nozzle 208 is provided with a bolt flange 216 to which is bolted a blind flange 220, and nozzle 210 has a bolt flange 218 to which is bolted a blind flange 222. As can also be seen, central nozzle 208 has a lifting eye 224.

Nozzle 206 extends into and is welded to the dome of vessel 12A, the lower end of nozzle 206 extending into the interior of vessel 12A. The other nozzles can likewise be welded to the dome of vessel 12A and extend upwardly therefrom. However, they can also extend through the dome of vessel 12A into the interior of vessel 12A if desired. Again, it is the goal of the nozzles to provide water tight "dry space" compartments for the various electronic and pneumatic modules that control the operation of the TSB.

Although in the elevational view of FIG. 4, only three nozzles are shown, it can be seen with reference to FIG. 5 that there can be six nozzles, center nozzle 208 and five circumferentially spaced nozzles in surrounding relationship to center nozzle 208. Fewer or more nozzles can be used if required to house the control system components in dry space. It can also be seen, particularly from FIG. 5 that center nozzle 208 is connected to each of the surrounding nozzles by conduits C. The conduits C are used to route wiring, cables, tubing, and the like between central nozzle 208 and the peripheral nozzles, e.g., 206, 210, etc.

With respect to nozzle 206 and as seen in FIG. 4, there is a tubular housing 240 having a bolt flange and a blind flange 241 and 242, respectively, disposed in nozzle 206. Disposed in tubular housing 240 is a compressed air cylinder 250. In practice, there can be two such cylinders in tubular housing 240, the compressed air cylinders 250 being used in the manner described above with respect to the compressed air cylinders shown in the embodiment of FIG. 1. Further, if necessary the two compressed air cylinders can be in separate nozzles. In other words, rather than having the compressed air cylinders exteriorly mounted to the TSB as shown in FIGS. 1, they are disposed in the dry space compartments afforded by housing 240 which in turn is in a dry space compartment provided by nozzle 206 as shown with respect to the embodiment of FIG. 4.

The other nozzles likewise serve the purpose of providing dry spaces for various other components. Thus, center nozzle 208 can be used to house an acoustic signal receiver and lithium battery while nozzle 210 could be used to house the control system for the compressed air cylinders, e.g., in the cylinder nozzle 206. Still further, the air equalizing system controller could be in one of the other nozzles, a liquid level transmitter in another nozzle and a rotolatch transmitter in yet another nozzle. As noted, conduits C provide closed pathways for electrical cables and instrument tubing needed to connect the various components in the peripheral nozzles to the battery supply and the receiver in the center nozzle 208.

As can be seen from the above, the TSB of the present invention provides an efficient system for holding and tensioning tendons prior to their connection to a platform or the like. In this regard, and as seen from above, holding/tensioning of the tendons using the TSB of the present invention can be accomplished with little to no in-water activity, such as the use of ROVs, divers, etc. Using the master controller/control system on board the tender or work ship, all function of the TSB can be carried out remotely using acoustic signaling.

In a typical platform installation procedure, a work barge carrying the tendons, TSBs, sea anchors, and other necessary equipment is positioned above the sea bed where the anchors are to be installed. The TSB, tendons, and the sea anchor are at the surface. The TSBs, connected tendons, and anchors are lowered for installation of the sea anchors, the TSB maintaining the tendons in a vertical position. When the platform to be installed has arrived at the site, and is adequately ballasted, the controller are activated to raise the vessels and heave the tendons to their final, held position. Chains from the deck-mounted winches are connected to the yoke of the harness assembly and the chains are tightened to reach the desired tension in the tendons. At this point, the TSBs are released and are moved back to the deck of a barge. At this point, a service vessel can then set in place an adjustable assembly tendon link, shown in FIG. 2. Once the adjustable link has been installed and adjusted, the harness assembly is released and taken away by the service vessel. In this next stage, the platform is deballasted so as to reach the final position with the tendons of course in tension.

To accommodate flexing stresses which can occur on the tendons, a sub assembly such as shown in FIG. 6 can be employed. The sub, shown generally as 290 in FIG. 6 can comprise a section 300 of flexible hose which is of the heavy duty, high strength type used in transferring petroleum products such as crude oil, diesel, gasoline, etc. The "petroleum hose" used herein can be a wire or steel mesh reinforced rubber hose of a type well known in the art. As shown in FIG. 6, the flexible tubular section 300 can have flanged connections such as 302 and 304 at opposite ends, whereby it can be connected in line to upper and lower portions of tubular member 72. Because of its high strength and flexibility, the sub 290 acts to accommodate flexing stresses caused by lateral forces, e.g., ocean currents acting on the tendon.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A system for supporting a tendon comprising:

a cylindrical vessel having a top end, a bottom end, and forming a chamber;

a connector on said cylindrical vessel proximate said bottom end;

an air vent on said cylindrical vessel proximate said top end;

a water control valve in said cylindrical vessel proximate said bottom end;

a source of pressurized air operatively connected to said chamber;

a harness assembly, said harness assembly comprising:

a yoke having a first end and a second end; and;

a clamp mounted on said yoke between said first and second ends, said harness assembly being releasably connectable to said cylindrical vessel.

2. The system of claim 1, wherein there is a control module mounted on said cylindrical vessel.

3. The system of claim 2, wherein said control module is operative to determine air pressure in said housing.

4. The system of claim 2, wherein said control module is operative to determine water level in said chamber.

5. The system of claim 2, wherein said control module is operatively connected to said source of pressurized air.

6. The system of claim 2, wherein said control module is operatively connected to said air vent.

7. The system of claim 2, wherein said control module is remotely operable from a handheld device.

8. The system of claim 1, wherein there is a sub assembly adapted to be releasably received in said clamp, said sub assembly having an upper end adapted to connect to said connector on said cylindrical vessel and a lower end adapted to connect to a tendon.

9. The system of claim 8, wherein said upper end of said sub assembly carries a rotolatch assembly.

10. The system of claim 8, wherein said clamp comprises first and second hinged sections, said hinged sections when closed providing a nest for said sub assembly.

11. The system of claim 8, wherein said sub assembly includes a flexible tubular section which is flanged on opposed ends.

12. The system of claim 11, wherein said flexible section comprise petroleum hose.

13. The system of claim 12, wherein said petroleum hose comprises a wire, reinforced rubber hose.

* * * * *